US011884473B2

(12) United States Patent
Gorman et al.

(10) Patent No.: US 11,884,473 B2
(45) **Date of Patent: *Jan. 30, 2024**

(54) MICROWAVE COOKING PACKAGE

(71) Applicant: Conagra Foods RDM, Inc., Chicago, IL (US)

(72) Inventors: Charles T. Gorman, Stillwater, MN (US); David W. France, Minneapolis, MN (US); Clifton Lachmansingh, South Haven, MN (US); Paul J. Warosh, Plymouth, MN (US); Donald L Greenwood, Bradenton, FL (US); Joseph C. Walsh, Boulder, CO (US); Nicholas P. Lupfer, Lakewood, CO (US); John D. Culter, Naples, FL (US)

(73) Assignee: Conagra Foods RDM, Inc., Chicago, IL (US)

( * ) Notice: Subject to any disclaimer, the term of this patent is extended or adjusted under 35 U.S.C. 154(b) by 122 days.

This patent is subject to a terminal disclaimer.

(21) Appl. No.: 17/155,333

(22) Filed: Jan. 22, 2021

(65) Prior Publication Data

US 2021/0387788 A1 Dec. 16, 2021

Related U.S. Application Data

(63) Continuation of application No. 15/862,714, filed on Jan. 5, 2018, now Pat. No. 10,906,722, which is a (Continued)

(51) Int. Cl.
*H05B 6/80* (2006.01)
*H05B 6/64* (2006.01)
(Continued)

(52) U.S. Cl.
CPC ..... *B65D 81/3469* (2013.01); *B65D 75/008* (2013.01); *B65D 2581/3421* (2013.01);
(Continued)

(58) Field of Classification Search
CPC ..... B65D 2205/00; B65D 2581/3421; B65D 2581/3472; B65D 2581/3494; B65D 75/008; B65D 77/225; B65D 81/3469
(Continued)

(56) References Cited

U.S. PATENT DOCUMENTS 7,022,359 B2 * 4/2006 Montserrate Gibernau ..... B65D 81/3461 426/112
8,729,437 B2 * 5/2014 Gorman ..... B65D 81/3469 219/730

* cited by examiner

*Primary Examiner* — Quang T Van
(74) *Attorney, Agent, or Firm* — Ryan T. Grace; Advent, LLP

(57) ABSTRACT

Microwave cooking packages suitable for use as microwave popcorn packages include at least one panel (e.g., first and second panels) formed of a vertically rigid material. A flexible portion is attached to the panels. The flexible portion may be formed of a polyester film material such as a biaxially-oriented polyethylene terephthalate (PET) film, which may be at least partially transparent. The flexible portion (and panels) defines a bag construction configured to contain a popcorn charge and to be expandable between a collapsed configuration and an expanded configuration when the popcorn charge is subjected to a popping operation. The microwave cooking package may include a vent assembly configured to at least partially open when the bag configuration is in an expanded configuration to vent the bag construction. The vent assembly includes a first portion a second portion of the bag construction that is configured to be folded against the first portion.

20 Claims, 12 Drawing Sheets

Related U.S. Application Data continuation of application No. 14/631,012, filed on Feb. 25, 2015, now Pat. No. 9,868,581, which is a continuation of application No. 12/953,123, filed on Nov. 23, 2010, now Pat. No. 9,079,704, which is a continuation of application No. 12/559,094, filed on Sep. 14, 2009, now Pat. No. 8,735,786, which is a continuation of application No. 11/970,349, filed on Jan. 7, 2008, now Pat. No. 8,729,437, said application No. 12/953,123 is a continuation of application No. 12/880,938, filed on Sep. 13, 2010, now Pat. No. 8,610,039, and a continuation of application No. PCT/US2010/048762, filed on Sep. 14, 2010, which is a continuation-in-part of application No. 12/559,094, filed on Sep. 14, 2009, now Pat. No. 8,735,786, and a continuation-in-part of application No. 12/880,938, filed on Sep. 13, 2010, now Pat. No. 8,610,039.

(60) Provisional application No. 60/879,142, filed on Jan. 8, 2007.

(51) Int. Cl.
*B65D 81/34* (2006.01)
*B65D 75/00* (2006.01)

(52) U.S. Cl.
CPC ..... *B65D 2581/3472* (2013.01); *B65D 2581/3494* (2013.01)

(58) Field of Classification Search
USPC ..... 219/727, 725, 730; 426/107, 115, 118, 426/413, 234, 243, 625, 627; 383/104, 383/122
See application file for complete search history.

MICROWAVE COOKING PACKAGE

CROSS-REFERENCE TO RELATED APPLICATIONS

The present application is a continuation of U.S. patent application Ser. No. 15/862,714 file Jan. 5, 2018, which is a continuation of U.S. patent application Ser. No. 14/631,012 filed Feb. 25, 2015, which is a continuation of U.S. patent application Ser. No. 12/953,123 filed Nov. 23, 2010, which is a continuation of U.S. patent application Ser. No. 12/559,094 filed Sep. 14, 2009, which is a continuation of U.S. patent application Ser. No. 11/970,349 filed Jan. 7, 2008, which claims the benefit of U.S. Patent Application Ser. No. 60/879,142 filed Jan. 8, 2007. U.S. patent application Ser. No. 12/953,123 filed Nov. 23, 2010 is also a continuation of U.S. patent application Ser. No. 12/880,938 filed Sep. 13, 2010, and is a continuation of PCT/US2010/048762 filed Sep. 14, 2010. PCT/US2010/048762 is a continuation-in-part of U.S. patent application Ser. No. 12/559,094 filed Sep. 14, 2009 is a continuation-in-part of U.S. patent application Ser. No. 12/880,938 filed Sep. 13, 2010.

BACKGROUND

Microwave cooking packages, and, in particular, microwave popcorn packages in current commercial use, typically employ two-ply paper constructions in which inner and outer flexible paper sheets or plies are laminated to one another. A microwave interactive sheet, typically referred to as a microwave susceptor, may be encapsulated between the two flexible paper sheets. The resulting microwave popcorn packages can be provided in a form that may be collapsed and folded when stored before use (e.g., when packaged for shipping, sale, and storage by a consumer). During popping, when a popcorn charge within the packages is exposed to microwave energy in a microwave oven, the bags unfold and expand. When the popping operation is completed, the package is opened and the contents emptied into a container such as a bowl or basket for consumption. The microwave popcorn package may then be collapsed for disposal. When a container is not available, the consumer may instead reach into the bag to obtain the contents.

SUMMARY

Microwave cooking packages suitable for use as microwave popcorn packages are disclosed. In implementations, the microwave cooking packages are comprised of at least one panel (e.g., first and second panels) formed of a vertically rigid material. A flexible portion (e.g., a flexible bag construction, first and second end portions, a single expandable portion, etc.) is attached to the panels. The flexible portion may be formed of a polyester film material such as a biaxially-oriented polyethylene terephthalate (PET) film, which may be at least partially transparent. The flexible portion (and panels) defines a bag construction configured to contain a popcorn charge and to be expandable between a collapsed configuration and an expanded configuration when the popcorn charge is subjected to a popping operation.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying figures. In the figures, the use of the same reference numbers in different instances in the description and the figures may indicate similar or identical items.

DETAILED DESCRIPTION

Overview

Figure 1A:
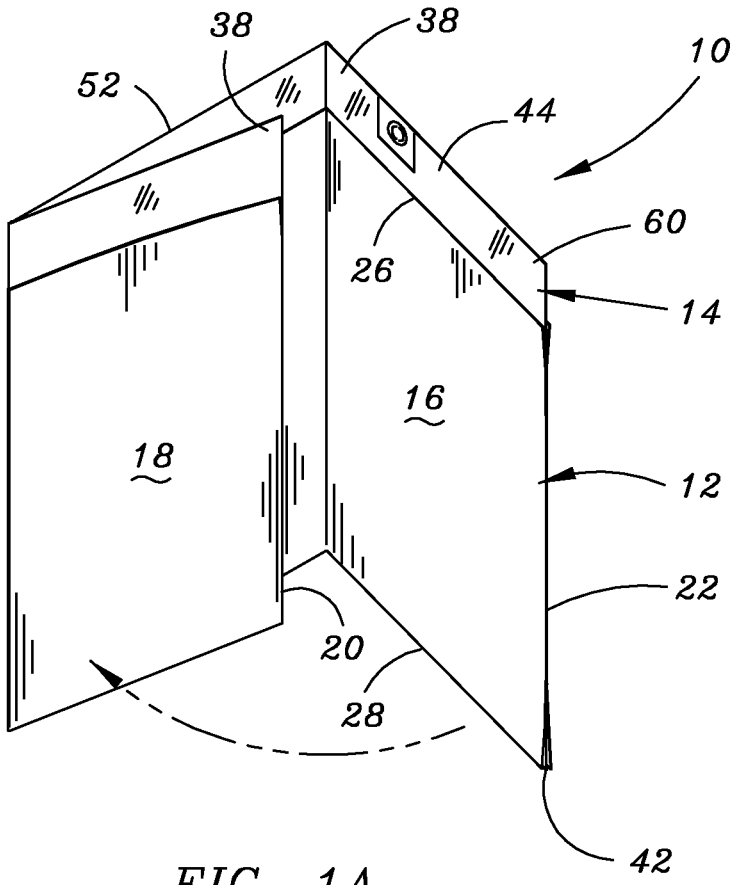
FIG. 1A is an isometric view illustrating an example microwave cooking package, in particular, a tri-fold microwave popcorn package, having a vent assembly in accordance with the present disclosure.

Microwave cooking packages may be used to facilitate cooking of a variety of food products in a microwave oven. In particular, in some implementations, microwave cooking packages may be configured as microwave popcorn packages used to pop popcorn.

Microwave cooking packages suitable for use as microwave popcorn packages are disclosed. The microwave cooking packages are comprised of at least one panel (e.g., first and second panels) formed of a vertically rigid material. A flexible portion (e.g., a flexible bag construction, first and second end portions, a single expandable portion, etc.) is attached to the panels and forms. The flexible portion may be formed of a polyester film material such as a biaxially-oriented polyethylene terephthalate (PET) film. The flexible portion (and panels) defines a bag construction configured to contain a popcorn charge and to be expandable between a collapsed configuration and an expanded configuration when the popcorn charge is subjected to a popping operation.

In implementations, the microwave cooking package (microwave popcorn package) may employ a bag construction, which may be formed of polyester film material such as a biaxially-oriented polyethylene terephthalate (PET) film, as the flexible portion. The bag construction is secured to an interior of a sidewall construction and may contain a popcorn charge as the food product. To form the flexible bag construction, one or more sheets of polyester (e.g., PET) film are folded to create expansion structures such as gussets, or the like, that allow the bag construction to expand to hold the popped popcorn. Edges of the polyester sheet are then sealed to one another using an adhesive (e.g., a water-based adhesive), forming seals, to hold the popcorn within the bag construction for shipping, storage, and popping. Following a popping operation (e.g., following popping of the one or more popcorn kernel(s) in the popcorn charge by heating the microwave popcorn package in a microwave oven), the bag construction and the sidewall construction may form a container having vertically rigid sidewalls to facilitate consumption of the popped popcorn.

The microwave cooking package (microwave popcorn package) may also employ a multiple component construction, wherein side panels of the sidewall construction form part of the flexible bag construction with the flexible portion. For instance, in one implementation, the microwave popcorn package may have a four component construction. The four component construction comprises a sidewall construction that includes first and second panels. First and second expandable end portions (e.g., end portions that include expansion structures such as gussets), which may be formed of sheets of a polyester (e.g., PET) film, are attached to the first and second panels to form the flexible bag construction. In another implementation, the microwave popcorn package may have a two component construction that includes only the second panel and a single flexible outer portion. In yet another implementation, the microwave popcorn package may have a three component construction that includes the second panel and the single flexible outer portion. In this three component configuration, a first panel is adhered to the outside surface of the single flexible outer portion opposite the second panel. Each of the aforementioned construction configurations forms a flexible bag construction that is configured to contain a popcorn charge.

During popping, the bag construction is expanded from a collapsed configuration to an expanded configuration by steam generated during popping and/or the expanded volume of the popped popcorn. This expansion of the bag construction due to increased pressure therein places stress on the seals of the bag construction, which, in some instances, could cause the seals to open spilling the contents (e.g., unpopped popcorn kernels, oils, seasonings, popped popcorn, and so on) from the package.

Accordingly, a vent assembly is disclosed for a microwave cooking package that comprises a bag construction formed of polyester film material such as a PET film, or the like. The vent assembly is formed within the bag construction and includes a first portion of the bag construction and a second portion of the bag construction that is configured to be folded against the first portion. For example, in one implementation, the vent assembly may be formed near a fold of a gusset of the bag construction so that the first portion and the second portion are positioned on either side of the fold. The second portion includes a venting structure formed in the sheet of polyester (e.g., PET) film material from which the bag construction is fabricated.

An adhesive is applied to at least one of the first portion or the second portion of the bag construction. While the bag construction is in the collapsed configuration (i.e. prior to popping), the adhesive adheres the first portion to the second portion so that the vent is at least partially sealed. However, as the bag construction expands to the expanded configuration during popping, the adhesive is configured to release the first portion from the second portion to allow the vent to at least partially open venting the bag construction. As utilized herein, the term "at least partially sealed" may be employed to describe a condition wherein the first portion and the second portion of the vent assembly seal the vent sufficiently to prevent substantial spilling of the contents (e.g., unpopped popcorn kernels, oils, seasonings, popped popcorn, and so on) from the package. Similarly, the term "at least partially open" may be employed to describe a condition wherein the vent is sufficiently open to vent pressure and/or steam within the bag construction.

In an implementation, the vent is comprised of one or more generally curved scores formed in the second portion that at least partially open when the first portion is released from the second portion. For example, the vent may comprise a first semi-circular score and a second semi-circular score, in mirrored relation to the first semi-circular score. The mirrored first and second semi-circular scores may be spaced apart from one another to form a land area there between.

Example Microwave Cooking Packages

An example microwave cooking package that employs a bag construction formed of polyester film material such as a PET film, which may be provided with a vent assembly in accordance with the present disclosure, is now described. In the figures discussed herein below, some relative material thicknesses and component sizes may be shown exaggerated, to facilitate an understanding of the disclosure. Additionally, as used herein, the terms "top" and "bottom" are used to refer to components, with reference to relative location after the package is configured in an expanded configuration and is stood up, for normal use. Thus, the terms "top" and "bottom" may be used to identify components even when those components are in the collapsed configuration, but with reference to eventual relative locations once the package is expanded and positioned (e.g., stood) on its bottom or base, for normal use.

FIGS. 1 through 4 illustrate an example microwave cooking package that is configured as a microwave popcorn package 10 suitable for use in popping popcorn in a microwave oven. As shown, the microwave popcorn package 10 includes a sidewall construction 12 and a flexible bag construction 14. The example sidewall construction 12 depicted includes first and second panels 16, 18 extending between ends 20, 22. The first and second panels 16, 18 may comprise separate pieces of material secured to one another, or, the panels 16, 18 may be folded from a single piece of material. For the particular sidewall construction 12 shown, each of the first and second panels 16 and 18 may be fabricated of a material that is adapted to be curved or configured from a flat or collapsed configuration into an expanded configuration having a generally convex arrangement, such as, for example a curved (e.g., ring) arrangement, a faceted (e.g., polygonal) arrangement, an irregular curved arrangement, and so on, to define the open top 24 depicted in FIG. 3. In the example shown, the first and second panels 16, 18 are generally identical to one another, positioned as mirror images in the microwave popcorn package 10. In general, the sidewall construction 12 may be vertically rigid. By the term "vertically rigid" and variants thereof, in this context, it is meant that the sidewall construction 12 is resistant to collapse when stood up in the orientation shown in FIG. 3 (e.g., in the vertical direction). However, the term "vertically rigid" is not necessarily meant to suggest the microwave popcorn package 10 cannot be collapsed, but rather that the package 10 is resistant to collapse under ordinary use conditions, and is more resistant to collapse than would be a flexible paper bag construction alone.

In implementations, the first and second panels 16, 18 may be fabricated of a paper, a paperboard material, or a cardboard material (e.g., cardstock). Herein, the term "paperboard" is meant to include various materials, including various forms of fiber board and the like provided the material selected is sufficiently vertically rigid to resist vertical collapse under conditions of normal use, when positioned as shown. A variety of paper and paperboard materials may be used provided the materials have sufficient vertical rigidity to function as an end container. For example, in an implementation, the first and second panels 16, 18 may be fabricated from a paper material of sufficient weight (e.g., gauge) to allow the panels 16, 18 to have substantial vertical rigidity in the direction from top edge 26 to bottom edge 28. In one example, the material used in fabrication of first and second panels 16, 18 may comprise a paper material having a weight of at least 60 lbs. per ream. However, paper materials having weights lighter than 60 lbs. per ream may also be used to fabricate the first and second panels 16, 18. Additionally, other materials such as film materials, plastic materials, and the like, may be used.

As shown, the sidewall construction 12 defines an interior 30 in which the flexible bag construction 14 is received. A food product, in this case, a microwave poppable popcorn charge 32, is contained within an interior 34 of the flexible bag construction 14. The first and second panels 16, 18, are joined at side ends 20, 22 with portions of the flexible bag construction 14 (in particular, portions of side seams formed in the bag construction 14) captured there between. The amount of curvature obtained in the first and second panels 16, 18 may depend upon such factors as: the thickness of the first and second panels 16, 18; the length of the first and second panels 16, 18 between the side ends 20, 22; the extent to which the package 10 is manipulated into the generally convex construction by the consumer; and so on.

As noted, the flexible bag construction 14 is comprised of a film material such as a polyester film material (e.g., a biaxially-oriented polyethylene terephthalate (PET) material, and so on), and may be single-ply or multiple (e.g., two) ply. In one or more implementations, the flexible bag construction may be generally transparent to allow the contents of the package 10 (e.g., popped popcorn) to be viewed. As used herein, the flexible bag construction 14 may be "generally transparent" if the contents of the bag construction 14 are at least partially visible through the bag construction 14. Thus, the flexible bag construction 14 may be generally transparent if the polyester film material from which the flexible bag construction 14 is constructed is completely transparent, translucent, transparent or translucent with opaque regions, transparent or translucent with printed indicia, tinted, and so on.

The flexible bag construction 14 provides an enclosure for the microwave poppable popcorn charge 32 during storage of the package 10 and popping. The unpopped microwave poppable popcorn charge 32 may include various components or additives such as fat/oil, salt, seasonings, nutrients, and so on, as are commonly used for microwave popcorn products. In one or more implementations, various components used as part of the charge 32, for example a fat, oil or other components, can be included within an internal pouch structure, for example the type described in the U.S. patent application having Ser. No. 10/299,537, incorporated herein by reference.

Figure 2A:
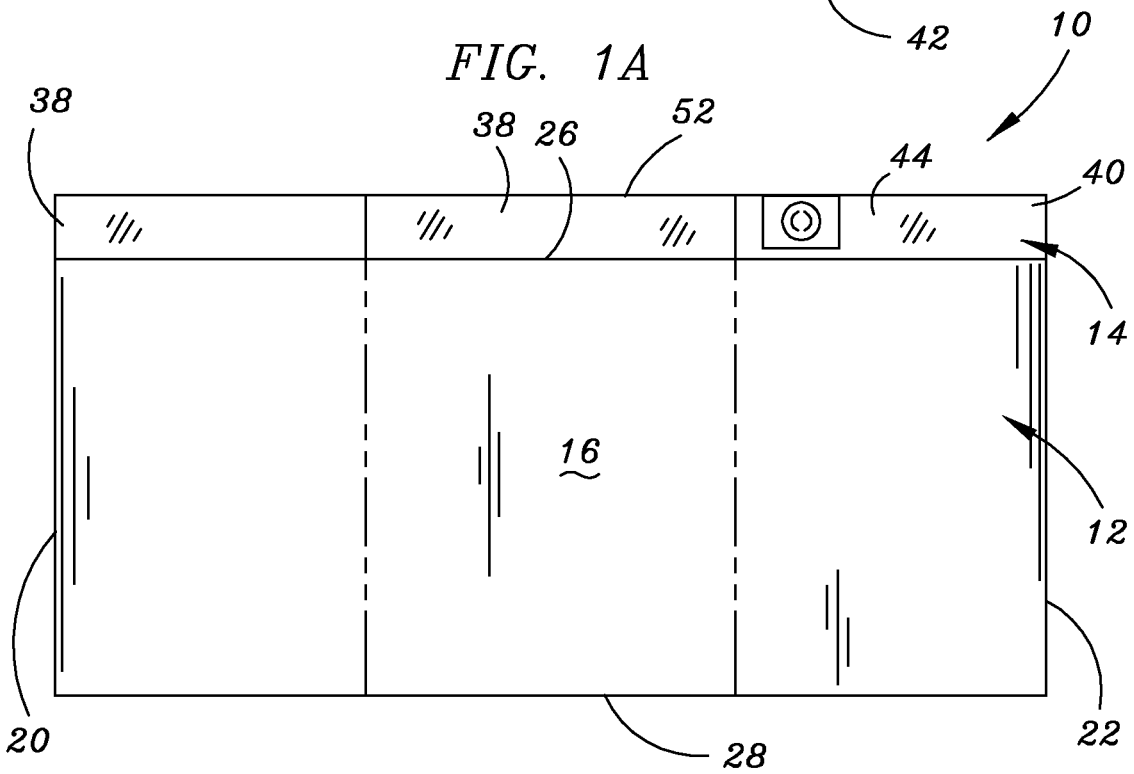
FIG. 2A is an isometric view of the microwave popcorn package shown in FIG. 1A, wherein the package is shown in a collapsed configuration prior to popping.
Figure 1B:
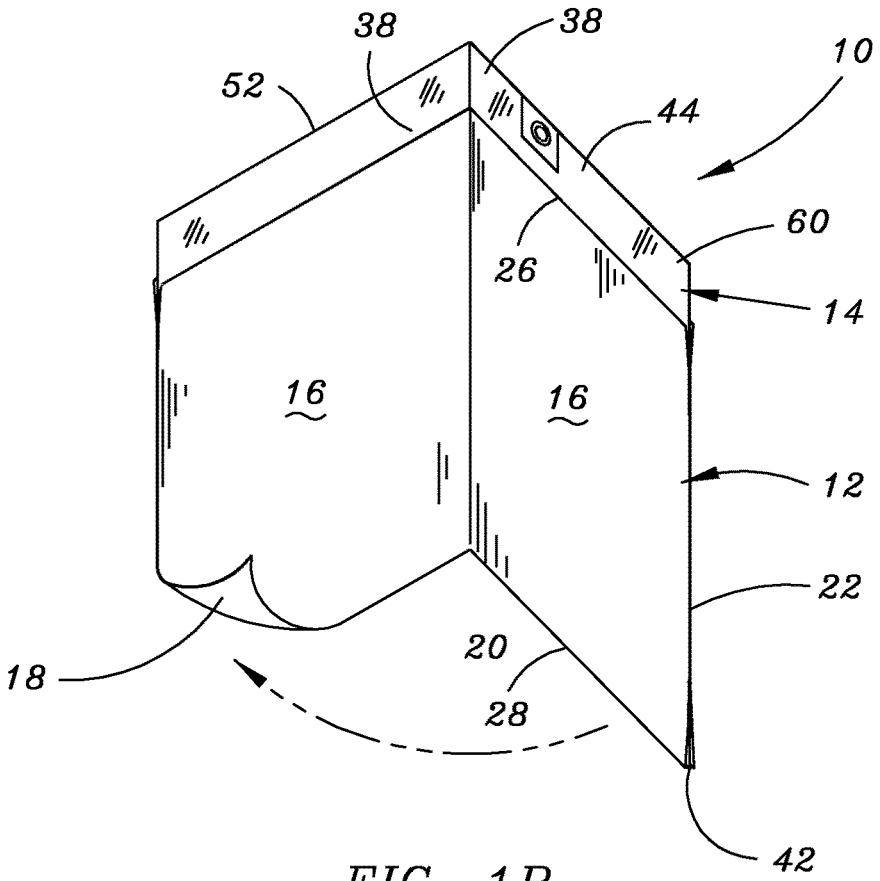
FIG. 1B is an isometric view illustrating an example microwave cooking package, in particular, a bi-fold microwave popcorn package, having a vent assembly in accordance with the present disclosure.
Figure 2B:
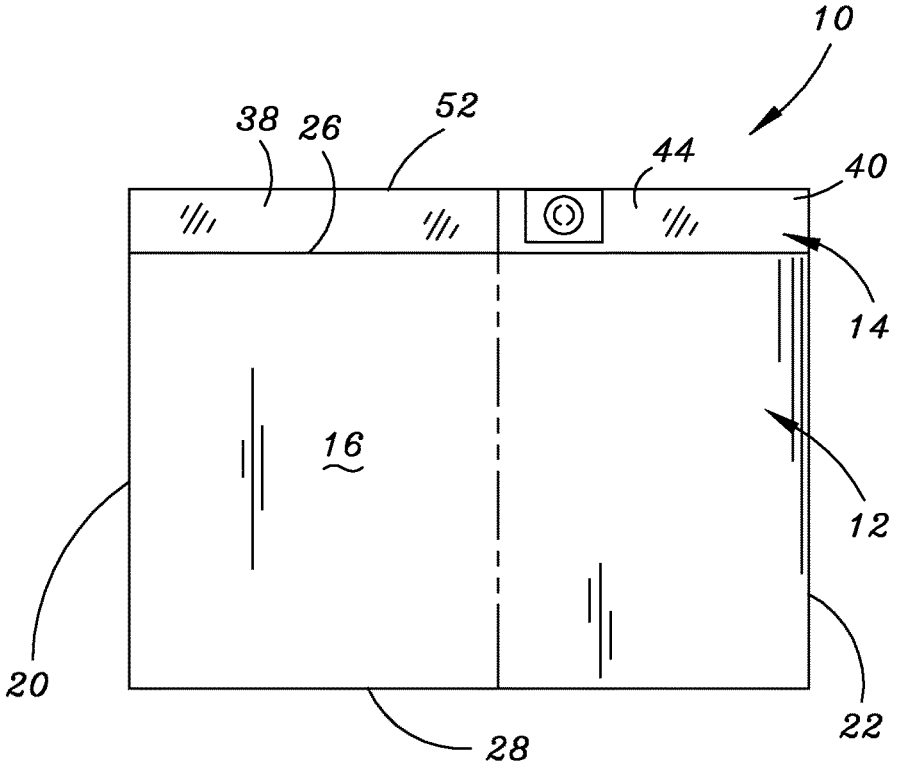
FIG. 2B is an isometric view of the microwave popcorn package shown in FIG. 1B, wherein the package is shown in a collapsed configuration prior to popping.

The flexible bag construction 14 may generally be viewed as having a collapsed configuration and an expanded configuration. The flexible bag construction 14 occupies the collapsed configuration prior to popping, and the expanded configuration after popping. In FIGS. 1 and 2 microwave popcorn package 10 is depicted in a collapsed configuration, e.g., as the package 10 appears before a popping operation, for example, after the package 10 has been placed in (e.g., on the floor or turntable of) a microwave oven for a popping operation.

Figure 6:
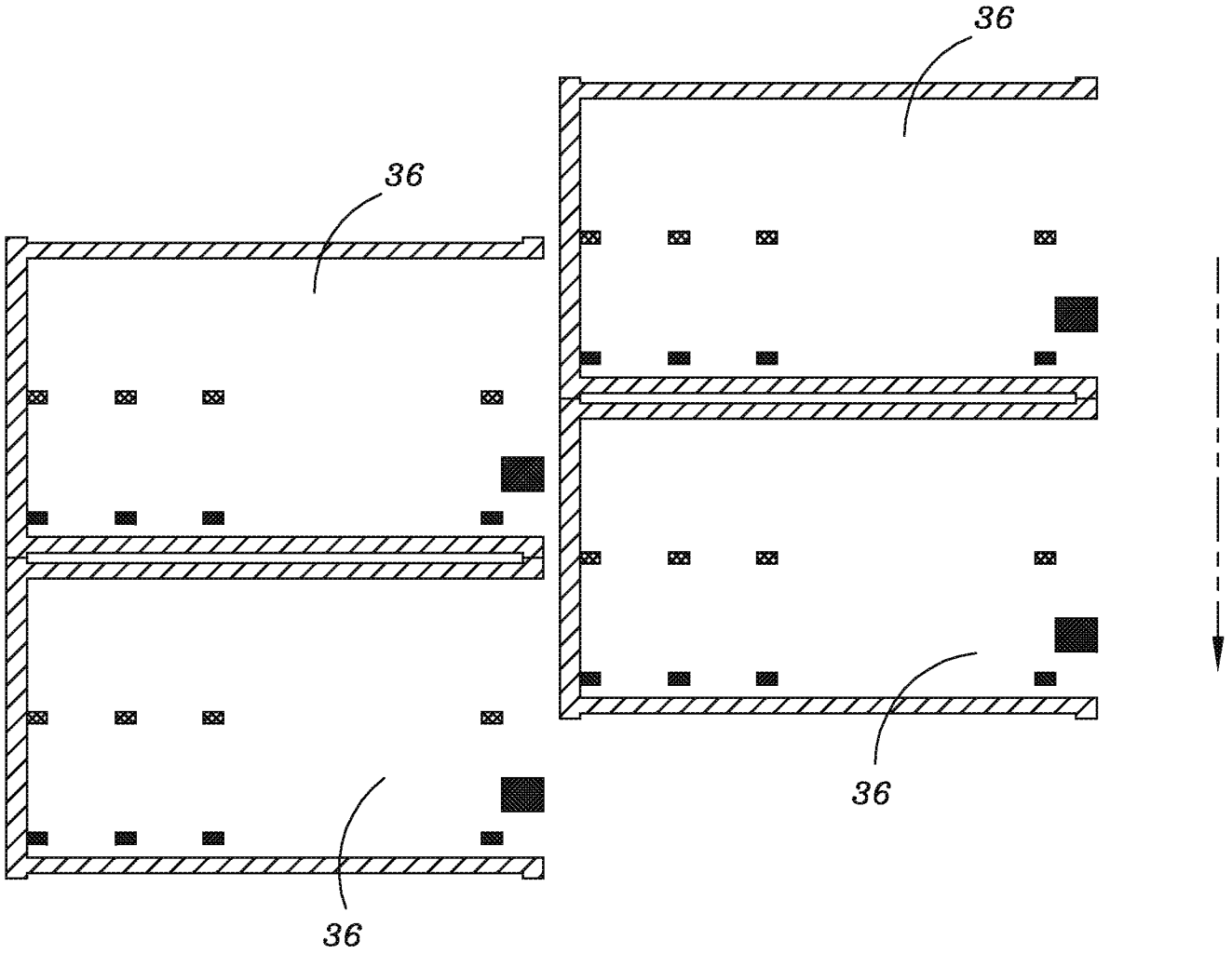
FIG. 6 is a plan view illustrating the application of adhesive to polyester film material stock to form the blank shown in FIG. 5.

In implementations, the flexible bag construction 14 may be folded from a single (e.g., one-piece) panel blank 36 (see FIG. 6). Folding of the blank 36 defines first and second opposite sides 38 and 40, with expansion structures (a bottom gusset 42 and a top gusset 44 are illustrated) positioned there between. The bottom and top gussets 42 and 44 may be longitudinal gussets that are "inwardly directed" so that center fold lines 46, 48 of the gussets 42, 44 are directed inwardly between sides 38, 40, from edges 50, 52, respectively. In one or more examples, the bottom gusset 42 may be larger (e.g., deeper) than the top gusset 44 since the bottom gusset 42 is configured to form the bottom of the bowl-like structure, while the top gusset 42 is configured to be removed following popping. It is contemplated that gussets 42, 44 may include multiple "inwardly directed" fold lines for larger size popcorn package 10 configurations (e.g., a "jumbo" size popcorn package 10 configuration).

Figure 8:
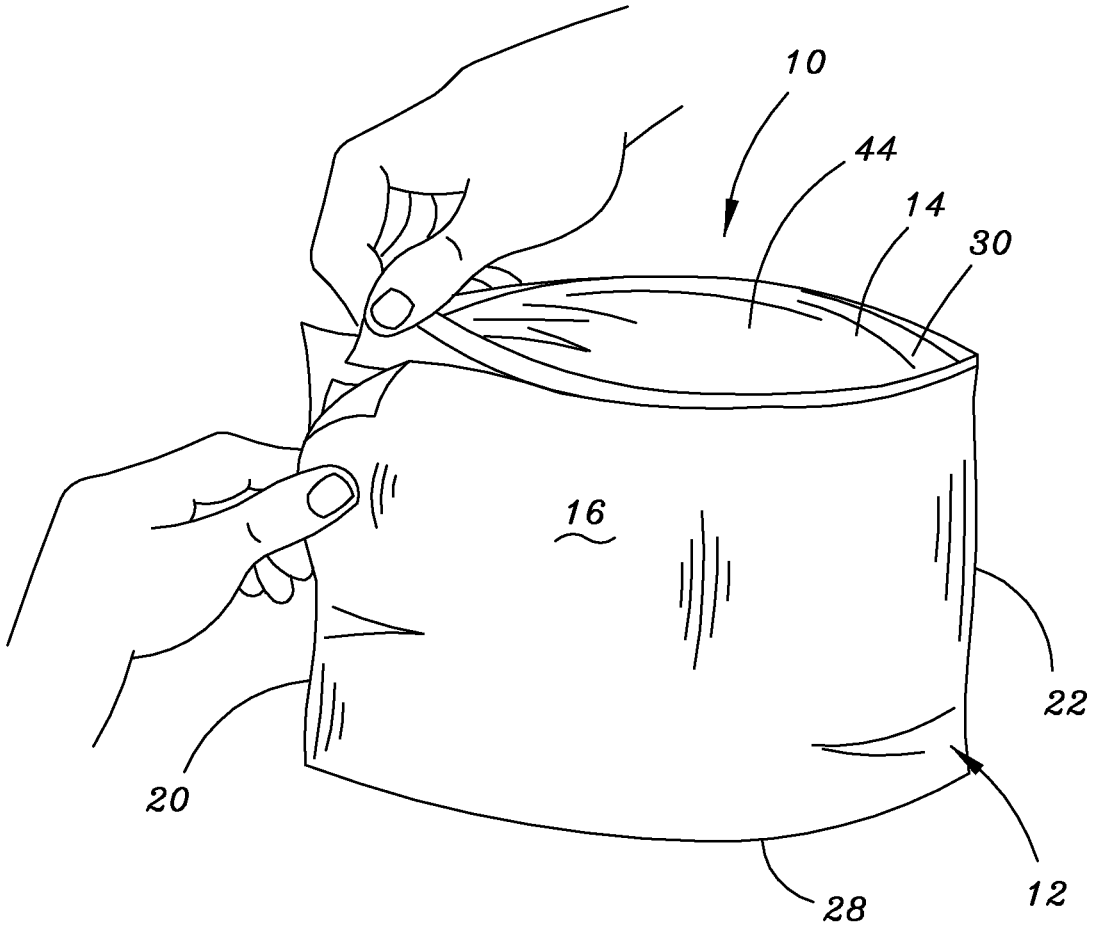
FIG. 8 is an isometric view of the microwave popcorn package shown in accordance with the present disclosure, wherein the package is shown in an expanded configuration following popping and one possible embodiment for removing the top gusset from the package is illustrated.

Following popping, the top gusset 44 is torn from the remainder of the microwave popcorn package 10 to expose the contents of the package 10 (e.g., popped popcorn) for consumption as shown in FIG. 8. When top gusset 44 is removed from the package 10, a bowl-like structure is provided from which the popped popcorn may be consumed. In some instances, after the top gusset 44 is removed, the consumer may increase the curvature to the sidewall construction 12 by pressing the side ends 20 and 22 of the first and second panels 16, 18 of the sidewall construction 12 together.

A variety of techniques may be used to facilitate removal of the top gusset 44 from the remainder of the flexible bag construction 14. For example, in the implementation illustrated, a tear line (e.g., a cut or notch) may be provided in the flexible bag construction 14 to facilitate opening of the bag construction 14 by removal of top gusset 44. The tear line may, for example, be positioned along an adhesive line at the base of the top gusset 44 where the flexible bag construction 14 attaches to the sidewall construction 12. Thus, the tear line is located below the top edge 26 of the sidewall construction 12 when the package 10 is in the expanded configuration. In other implementations, the flexible bag construction 14 may employ tear tape affixed to the bag construction 12 to facilitate tearing of the top gusset 44 from the remainder of the flexible bag construction 14. In such implementations, the tear tape may extend along and be generally parallel to the adhesive line at the base of the top gusset 44 where the flexible bag construction 14 attaches to the sidewall construction 12. Thus, the tear tape is likewise positioned below the top edge 26 of the sidewall construction 12 when the package 10 is in the expanded configuration. In one example, the tear tape may be fabricated from a high-temperature polyester material having a width of about 0.25 in. The tear tape and/or the underlying polyester film material may further include one or more score(s) (e.g., using a laser) to facilitate tearing.

In FIGS. 4, 9, 10, 11, and 12, the microwave popcorn package 10 is illustrated as including a microwave susceptor 54, which is shown positioned in thermoconductive relation to a central region 56 of the flexible bag construction 14. In the implementation illustrated in FIG. 4, the microwave susceptor 54 is attached (e.g., adhered) directly to the side 40 of the flexible bag construction 14. The second panel 18 is then adhered to the side 40 over the microwave susceptor 54. In other implementations, the microwave susceptor 54 may be affixed to the second panel 18, and the second panel 18 and microwave susceptor 54 affixed to the side 40 of the flexible bag construction 14. The microwave susceptor 54 may comprise a low optical density microwave susceptor, a patterned microwave susceptor, and so on. Herein, the terms "low optical density microwave susceptor" and "patterned microwave susceptor" are meant to refer to constructions, which, upon exposure to microwave energy in a microwave oven, generate an amount of heat that is sufficient to provide popping, but do not cause excessive damage (e.g., melting, softening, scorching) to the adjacent portions of the flexible bag construction 14. For instance, in implementations where the flexible bag construction 14 is formed of a polyester film such as PET, the microwave susceptor 54 may be configured so that the temperature of the polyester film adjacent to the microwave susceptor 54 does not exceed a predetermined limit (e.g., the softening point of the film, the melting point of the film, and so on). In one example, the microwave susceptor 54 may be configured as a low optical density microwave susceptor that has an optical density of 0.10 so that the temperature of the polyester material adjacent to the microwave susceptor 54 does not exceed approximately 425-450° F. (approximately 218-232 C).

In FIGS. 4, 9, 10, 11, and 12, the unpopped popcorn charge 32 is shown positioned within the interior 34 of the flexible bag construction 14 in the central region 56 over, and in thermoconductive contact with, microwave susceptor 54. When the microwave popcorn package 10 is placed in a microwave oven in the general orientation shown in FIGS. 2, 4, 9, 10, 11, and 12, and is exposed to an adequate level of microwave energy, heat and generated steam and/or vapor will cause expansion of the flexible bag construction 14 and thus the package 10. As the flexible bag construction 14 expands during popping, the first and second panels 16, 18 are pushed away from one another and the bottom gusset 42 and top gusset 44 are opened. In the implementation shown, the first and second panels 16, 18 may have a width that is narrower than the flexible bag construction 14 so that at least part of the flexible bag construction 14 (e.g., part of the top gusset 44) projects outwardly from between the first and second panels 16, 18 beyond the top edge 26. However, in other implementations, the first and second panels 16, 18 may have about the same width as the flexible bag construction 14 so that the first and second panels 16, 18 enclose the flexible bag construction 14 prior to popping.

In example implementations, the microwave popcorn package 10 may be configured to provide outer dimensions of at least about 20 cm (e.g., 20-40 cm) long (wide) by at least about 10 cm (e.g., 10 to 22 cm) high, when collapsed, and to contain 25 to 80 g unpopped popcorn kernels. It is contemplated that package 10 may be configured to provide smaller dimensions to produce a smaller package configuration (e.g., a "mini" popcorn package configuration). It is also contemplated that package 10 may be configured to provide larger dimensions to produce a larger package 10 configuration (e.g., a "jumbo" popcorn package configuration). The package 10, prior to a popping operation, can be conveniently folded in thirds (as shown in FIG. 1A) or halves (as shown in FIG. 1B) and stored within a moisture barrier outer package or wrap, such as a polyethylene or oriented polypropylene wrap, for storage, shipment, and display. Several such wrapped packages 10 may be stored in a cardboard box, or like container, for shipping, sale, and storage. In addition, indicia (e.g., graphics, text, etc.) may be printed on the surfaces of the first and second panels 16, 18, as well as the flexible bag construction 14. Moreover, in implementations, the interior surface of the second panel 18 (and the first panel 16) may be treated to be grease resistant (e.g., with a film forming starch treatment, an alginate treatment, an acrylic resin treatment, a fluorochemical treatment, or the like).

Figure 3:
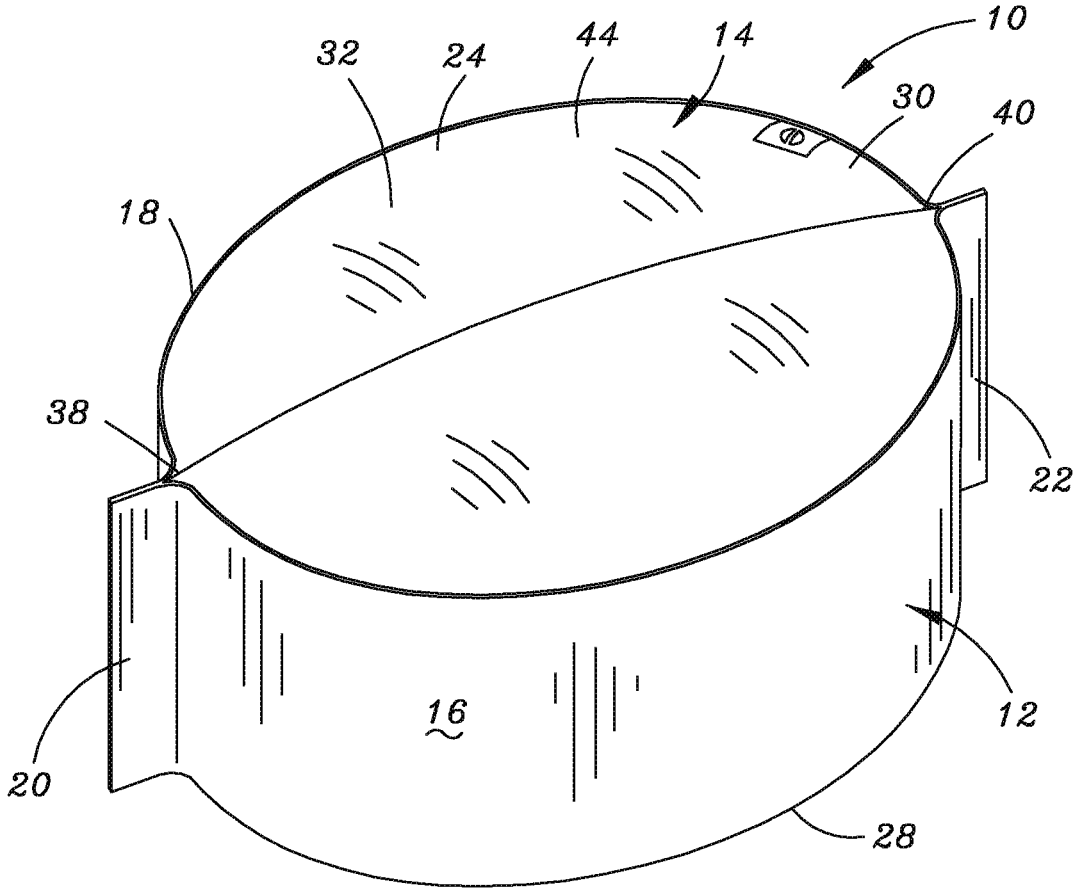
FIG. 3 is an isometric view of the microwave popcorn package shown in FIG. 1, wherein the package is shown in an expanded configuration following popping.
Figure 4:
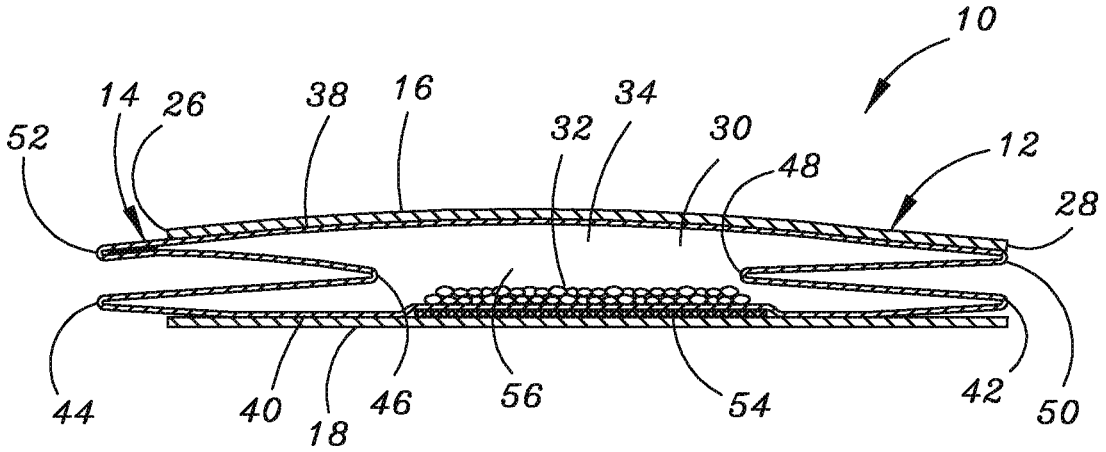
FIG. 4 is a cross-sectional view of the microwave popcorn package shown in FIG. 1.
Figure 5:
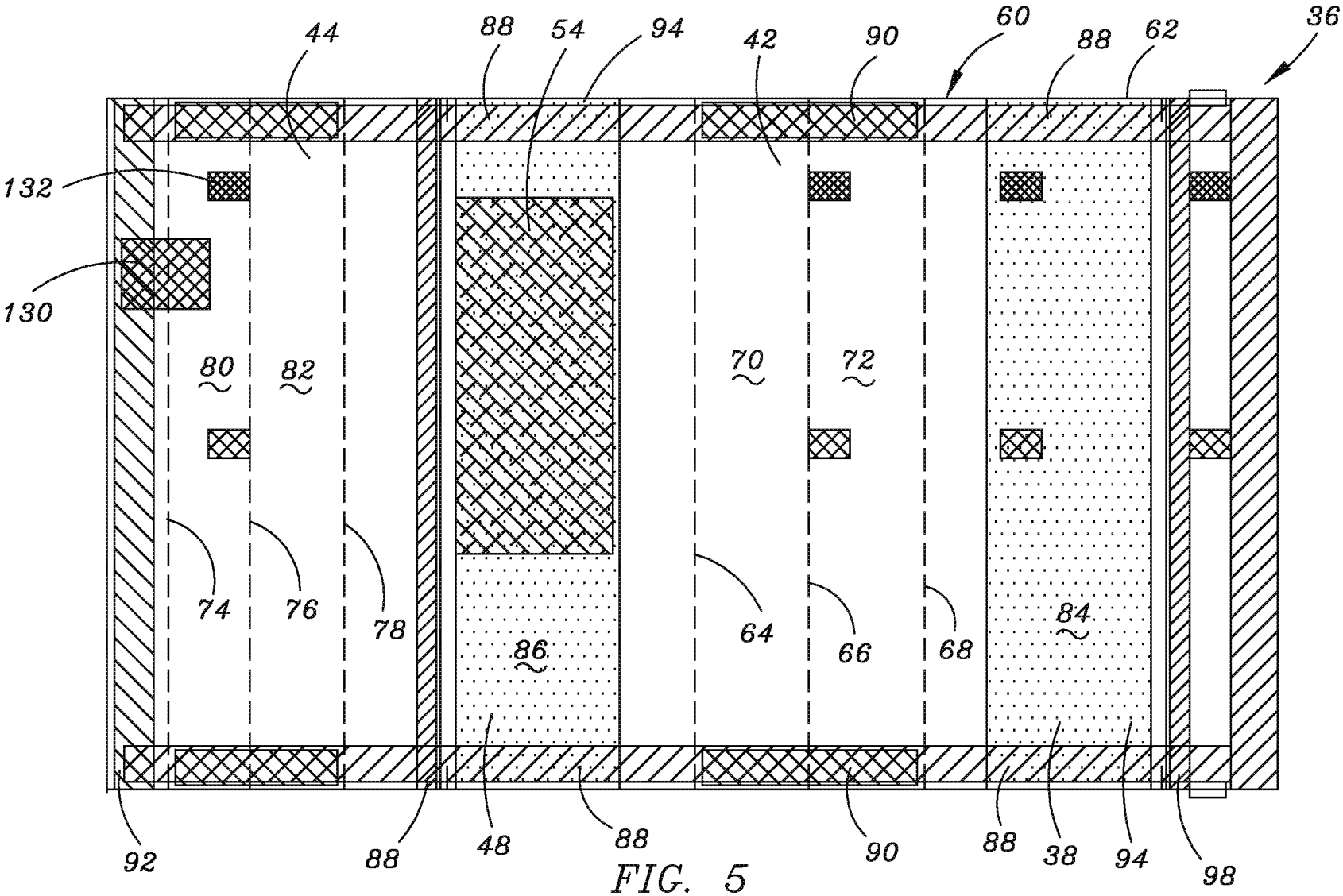
FIG. 5 is a plan view illustrating an example blank that may be folded into the bag construction of the microwave popcorn package shown in FIG. 1.
Figure 7:
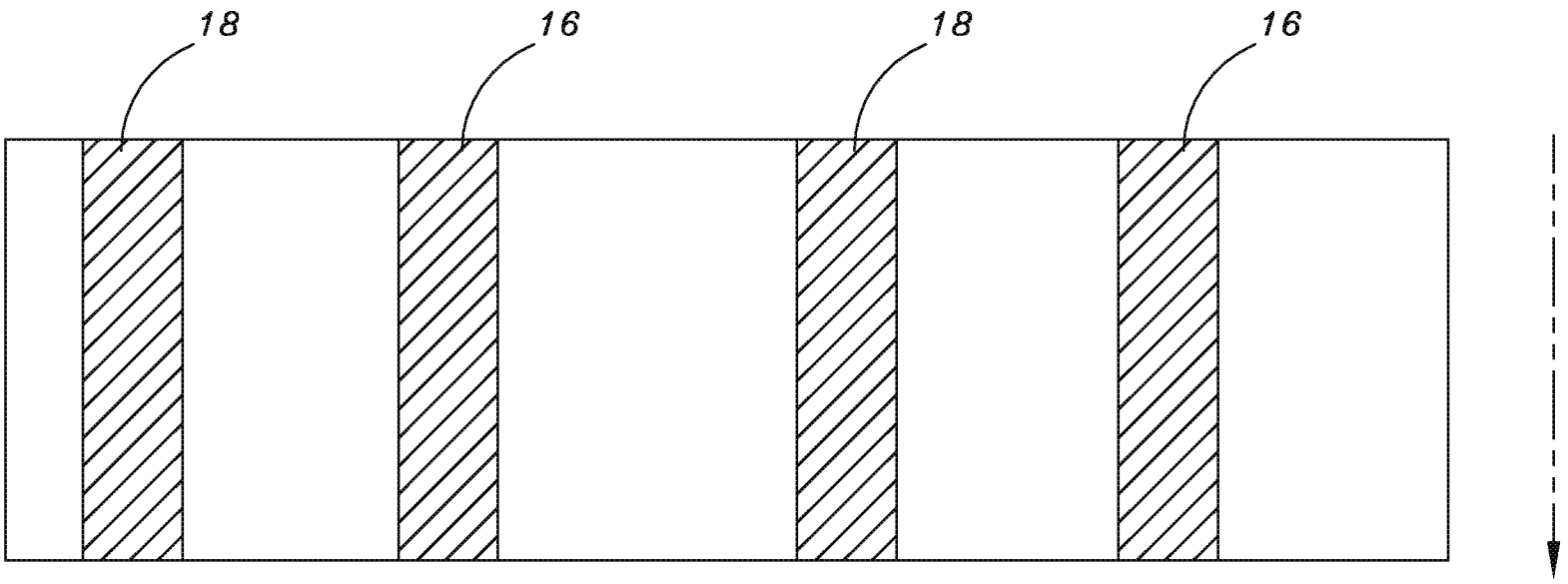
FIG. 7 is a plan view illustrating the application of paper stock to the polyester film material stock shown in FIG. 6.

Turning now to FIGS. 5, 6, and 7, example techniques for fabricating the microwave popcorn package 10 shown in FIG. 4 are described. FIG. 5 illustrates an example blank 36 suitable for use in fabrication of the flexible bag construction 14 described herein in reference to FIGS. 1 through 4. In FIG. 5, the example blank 36 comprises a foldable one-piece (e.g., single piece) bag blank 60 having a single-ply construction 62 with the susceptor 54 affixed to the back side of the blank 60 (i.e., opposite side from the view of FIG. 5). As described herein, the bag blank 60 may comprise a polyester film (e.g., PET) material, and may be generally transparent as described above. For instance, in a specific example, the blank 60 may be formed of transparent 92 gauge PET film. However, the use of blanks 60 formed of other materials is contemplated. Additionally, the particular bag blank 60 depicted is rectangular. However, it is contemplated that the bag blank 60 may have other shapes.

The notations described below in relation to FIG. 5 indicate: locations of fold lines; locations of seal or seam material; score lines; and a location for attachment of the susceptor 54. Three folds along lines 64, 66, 68 are used to form the bottom gusset 42 with interior panels 70, 72 (see FIG. 4). Similarly, three folds along lines 74, 76, 78 are used to form the top gusset 44 with interior panels 80, 82 (see FIG. 4). The resulting bottom gusset 42 and top gusset 44 are longitudinal, internally directed gussets as described in the discussion of FIGS. 1 through 4.

Opposite first and second sides 38, 40 of the flexible bag construction 14 are formed by regions 84 and 86, respectively. Adhesive in area 88 is used to seal the edges of sides 38, 40 together, thereby forming a bag configuration. The resulting side edges of the flexible bag construction 14 formed from folding the blank 60 may be positioned between the panels 16, 18 and secured into and along the end seams (FIG. 3). In regions 90, adhesive is also provided on the back side (i.e., opposite side from the view of FIG. 5) to provide the respective bottom and top gussets 42, 44. Adhesive in region 92 is further provided on the back side (i.e., opposite side from the view of FIG. 5) to seal the flexible bag construction 14 closed along the top gusset 44. Indicia, such as a tinted (e.g., red) bar, or the like, may be applied to areas to the blank 60, for example, to aide in providing instruction to direct a consumer in opening of the package 10 following popping.

As shown, the bag blank 60 includes adhesive areas 94 that are disposed on the back sides (i.e., opposite side from the view of FIG. 5) of the first and second sides 38, 40, respectively. The adhesive areas 94 secure the first and second sides 38, 40 of the flexible bag construction 14 to the interior of the sidewall construction 12. In FIGS. 4 and 5, the microwave susceptor 54 is affixed to the back side of the second side 40. Adhesive within adhesive areas 94 is then applied over the microwave susceptor 54.

Tear tape 98 may be applied to the blank 60 to facilitate tearing of the top gusset 44 from the remainder of the flexible bag construction 14. As shown, the tear tape 98 may extend along the edges of adhesive areas 94. The tear tape and/or the underlying blank 60 may further include one or more score(s) to facilitate removal of the top gusset 44.

Assembly of the microwave popcorn package 10 described herein may be accomplished in a number of ways. For example, a bag blank 60 as shown in FIG. 5 may be provided. Adhesive may be applied to the bag blank 60. FIG. 6 illustrates the application of adhesive to polyester film material stock to form the blank 36 shown in FIG. 5. Panels 16, 18 and microwave susceptor 54 may be adhered to the bag blank 60 where indicated by the sealant fields of FIG. 5 before folding. The assembly is then folded into a bag construction 14 and sealed as indicated. In one example, bag blanks 36 and panels 16, 18 may be provided in one or more rolls of stock, which are unrolled and adhered together. For example, the polyester film material stock shown in FIG. 6 is illustrated as having a width of two or more blanks 36. Similarly, FIG. 7 illustrates the alignment of paper stock for application of panels 16, 18 to the polyester film material stock shown in FIG. 6. Microwave interactive element 54 may likewise be provided in a roll or strip, registered with the bag blank 60 (and/or panels 16, 18) and adhered thereto. The assembly may then be cut and folded. The popcorn charge may then be distributed into the flexible bag construction 25 into the region adjacent the microwave interactive element 45, and the flexible bag construction 25 sealed.

FIGS. 9 through 13 illustrate example microwave cooking packages 10 that are fabricated using multiple component construction techniques instead of techniques that employ pre-fabricated blanks 60 as described above. In these implementations, the microwave cooking packages 10 may be formed from multiple rolls of paper and/or polyester film (e.g., PET) stock that are joined together, folded, cut, and/or filled during a fabrication process.

Figure 9:
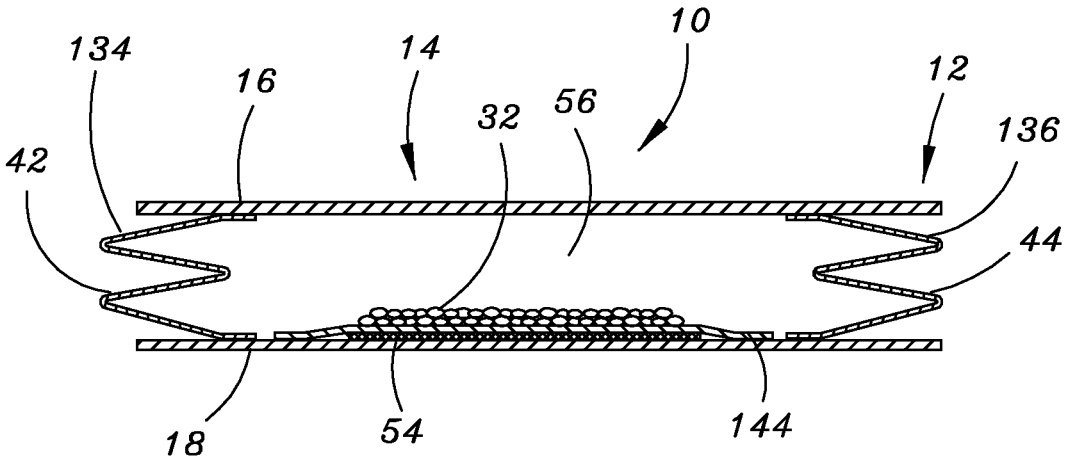
FIG. 9 is a cross-sectional view of the microwave popcorn package shown in accordance with the present disclosure, wherein the sidewall construction comprises a single ply material.
Figure 10:
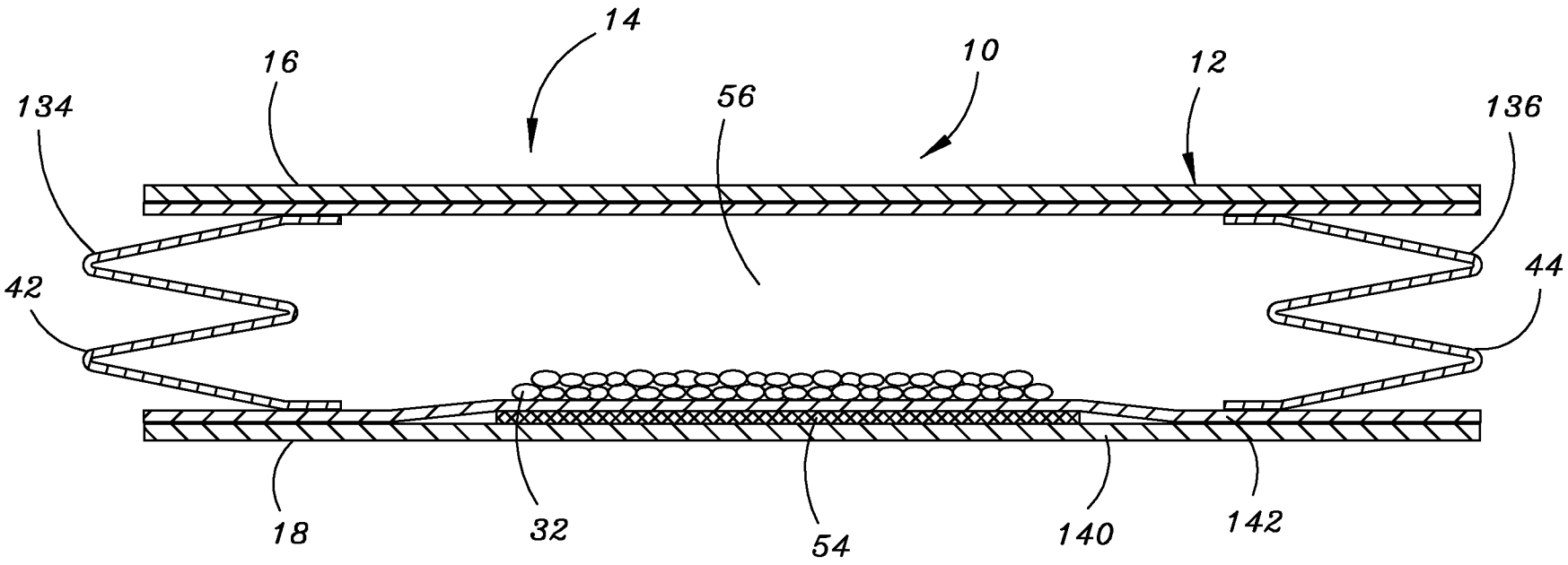
FIG. 10 is a cross-sectional view of a microwave popcorn package shown in accordance with the present disclosure, wherein the sidewall construction comprises a two ply material.

FIGS. 9 and 10 illustrate example microwave popcorn packages 10 that are fabricated from four component material stocks (i.e., a four-piece microwave popcorn package). As shown, the microwave popcorn package 10 includes a sidewall construction 12 that includes first and second panels 16, 18, each having first and second ends 20, 22 and top and bottom edges 26, 28. First and second expandable end portions 134, 136 are adhered to, and extend between, the first and second panels 16, 18 of the sidewall construction 12 proximate to top and bottom edges 26, 28, respectively. The first and second panels 16, 18 and first and second end portion 134, 136 thus form a flexible bag construction 14, which may be loaded with the popcorn charge 32, and is configured to be expandable between a collapsed configuration and an expanded configuration when the popcorn charge is subjected to a popping operation. The first end portion 134 is further configured to be removed from the remainder of the flexible bag construction 14 following the popping operation to facilitate consumption of the popped popcorn (e.g., as shown in FIG. 8).

As illustrated in FIGS. 9 and 10, the first and second expandable end portions 134, 136 may comprise a bottom (e.g., first) gusset 42 and a top (e.g., second) gusset 44, respectively. The bottom and top gussets 42 and 44 may be longitudinal gussets that are "inwardly directed" as described in reference to FIG. 4 above. In one or more examples, the bottom gusset 42 may be larger (e.g., deeper) than the top gusset 44 since the bottom gusset 42 is configured to form the bottom of the bowl-like structure, while the top gusset 42 is configured to be removed following popping.

Figure 11:
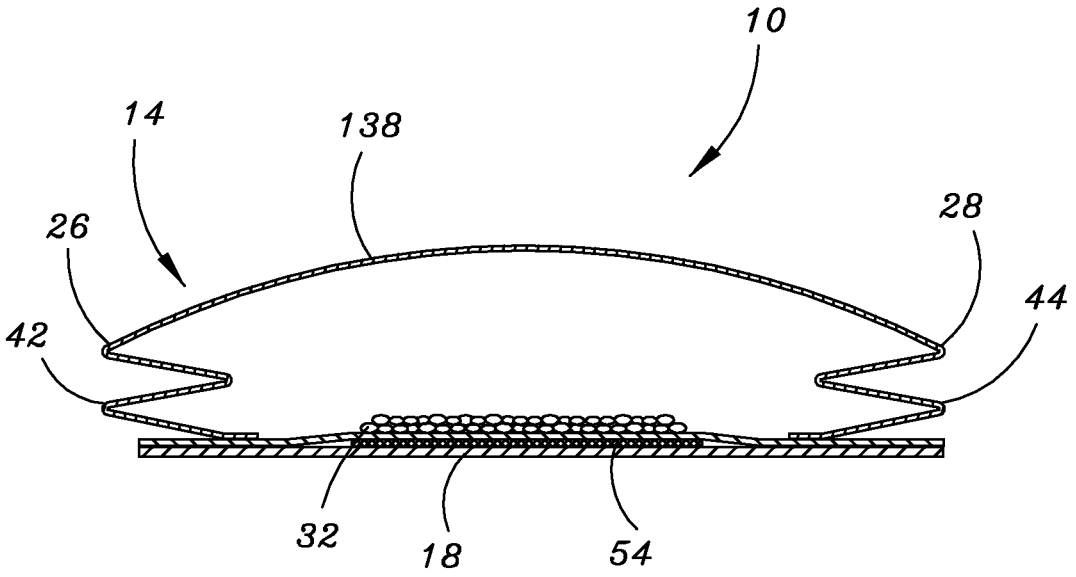
FIG. 11 is a cross-sectional view of a two-piece microwave popcorn package shown in accordance with the present disclosure.

FIG. 11 illustrates an example microwave popcorn package 10 that is fabricated from two component material stocks (i.e., a two-piece microwave popcorn package). As shown, first panel 16 is eliminated so that the microwave popcorn package 10 includes only the second panel 18. A single flexible outer portion 138 is adhered to the panel 18 proximate to top and bottom edges 26, 28, respectively, to form the flexible bag construction 14, which may be loaded with a popcorn charge 32. Folding of the outer portion 138 defines first and second opposite sides 26, 28, where the first side 26 includes a bottom (e.g., first) gusset 42 and the second side 28 includes a top (e.g., second) gusset 44.

Figure 12:
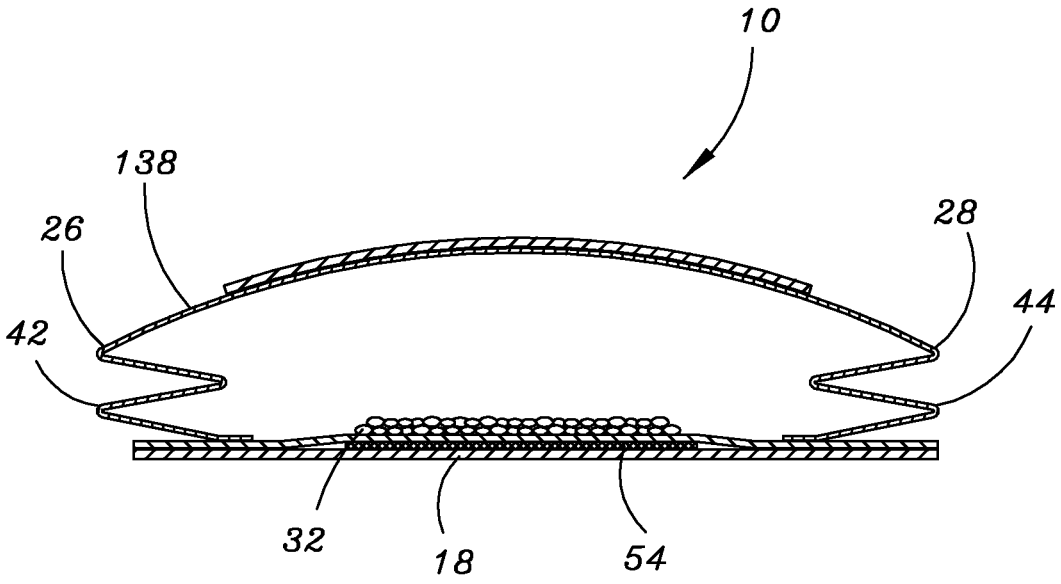
FIG. 12 is a cross-sectional view of a three-piece microwave popcorn package shown in accordance with the present disclosure.

FIG. 12 illustrates an example microwave popcorn package 10 that is fabricated from two component material stocks (i.e., a three-piece microwave popcorn package). Like the microwave cooking package of FIG. 11, the microwave popcorn package 10 shown in FIG. 12 includes a second panel 18 and a single flexible outer portion 138, which combine to form a flexible bag construction 14 that may be loaded with a popcorn charge 32. However, a first panel 16 is adhered to the outer surface of the single flexible outer portion 138 opposite the second panel 18. Folding of the single flexible outer portion 138 defines first and second opposite sides 26, 28, where the first side 26 includes a first gusset 42 and the second side 28 includes a second gusset 44.

Like the implementations described above in relation to FIGS. 1 through 7, the first and/or second panels 16, 18 of the microwave cooking package 10 shown in FIGS. 8 through 13 may be formed of a variety of paper materials such as paper, paperboard, and so on. The first and/or second panels 16, 18 are affixed to the first and second expandable end portions 134, 136 or the single flexible outer portion 138 with an adhesive, or the like. In implementations, the interior surface of one or both of the first and second panels 16, 18 may be treated to be grease resistant (e.g., with a film forming starch treatment, an alginate treatment, an acrylic resin treatment, a fluorochemical treatment, or the like). One or both of the first and second panels 16, 18 may be fabricated of a single ply material as illustrated in FIG. 9, or may comprise a multi-ply construction as illustrated in FIGS. 10, 11, and 12. Where a multi-ply construction is employed, as shown in FIGS. 10, 11 and 12, either or both of the first and second panels may include an outer ply 140 and an inner ply 142 adhered together. Thus, for example, the outer ply 140 may comprise a paper material having a weight (e.g., paperweight) sufficient to provide vertical rigidity while the inner ply is treated to be grease resistant. Moreover, in an implementation, the first panel 16 may comprise paper material(s) having a weight (e.g., paperweight) different than the weight (e.g., paperweight) of paper material(s) of the second panel 18. Additionally, non-paper materials such film materials, plastic materials, and so forth, may be used.

In implementations, the first and second end portions 134, 136 (FIGS. 9 and 10) and/or the flexible outer portion 138 (FIGS. 11 and 12) may be formed of a film material such as a polyester film material (e.g., a biaxially-oriented polyethylene terephthalate (PET) material, and so on), and may be single-ply or multiple (e.g., two) ply. However, it is contemplated that the first and second end portions 134, 136 may be formed of a paper material, which may be treated to be grease resistant. The first and second end portions 134, 136 and/or the flexible outer portion 138 may be generally transparent as discussed herein above so that the contents of the package 10 (e.g., popped popcorn) are at least partially visible.

In FIGS. 9 through 12, microwave interactive construction (e.g., a microwave susceptor) 54 is shown positioned in thermoconductive relation to a central region 56 of the flexible bag construction 14 adjacent to the second panel 18. In the implementation shown in FIG. 9, the microwave interactive construction 54 is shown positioned on an internal surface of the second panel 18. A patch 144, which may be formed of a paper material such as a grease resistant paper, is adhered to the second panel 18 over the microwave interactive construction 54. In the implementation shown in FIGS. 10, 11, and 12, the microwave interactive construction 54 is positioned between the plies 140, 142 of the flexible bag construction 14. The unpopped popcorn charge 32 is shown positioned within the interior 34 of the flexible bag construction 14 in the central region 56, over, and in thermoconductive contact with, microwave interactive construction 54. When the microwave cooking package 10 is placed in a microwave oven in the general orientation shown, and is exposed to an adequate level of microwave energy, heat and generated steam or vapor may cause expansion of the flexible bag construction 14 and thus the package 10. While FIGS. 4 and 9 through 12 illustrate popcorn packages 10 that include a microwave interactive construction 54, it is contemplated that package 10 can be manufactured without a microwave interactive construction 54. For example, a miniature (e.g., "mini") popcorn package 10 configuration may be manufactured without a microwave interactive construction 54.

The flexible bag construction 14 may generally be viewed as having a collapsed configuration and an expanded configuration. The flexible bag construction 14 occupies the collapsed configuration prior to popping, and the expanded configuration after popping. In FIGS. 10 through 13, microwave popcorn package 10 is depicted in a collapsed configuration, e.g., as the package 10 appears before a popping operation, for example, after the package 10 has been placed in (e.g., on the floor or turntable of) a microwave oven for a popping operation.

Figure 13:
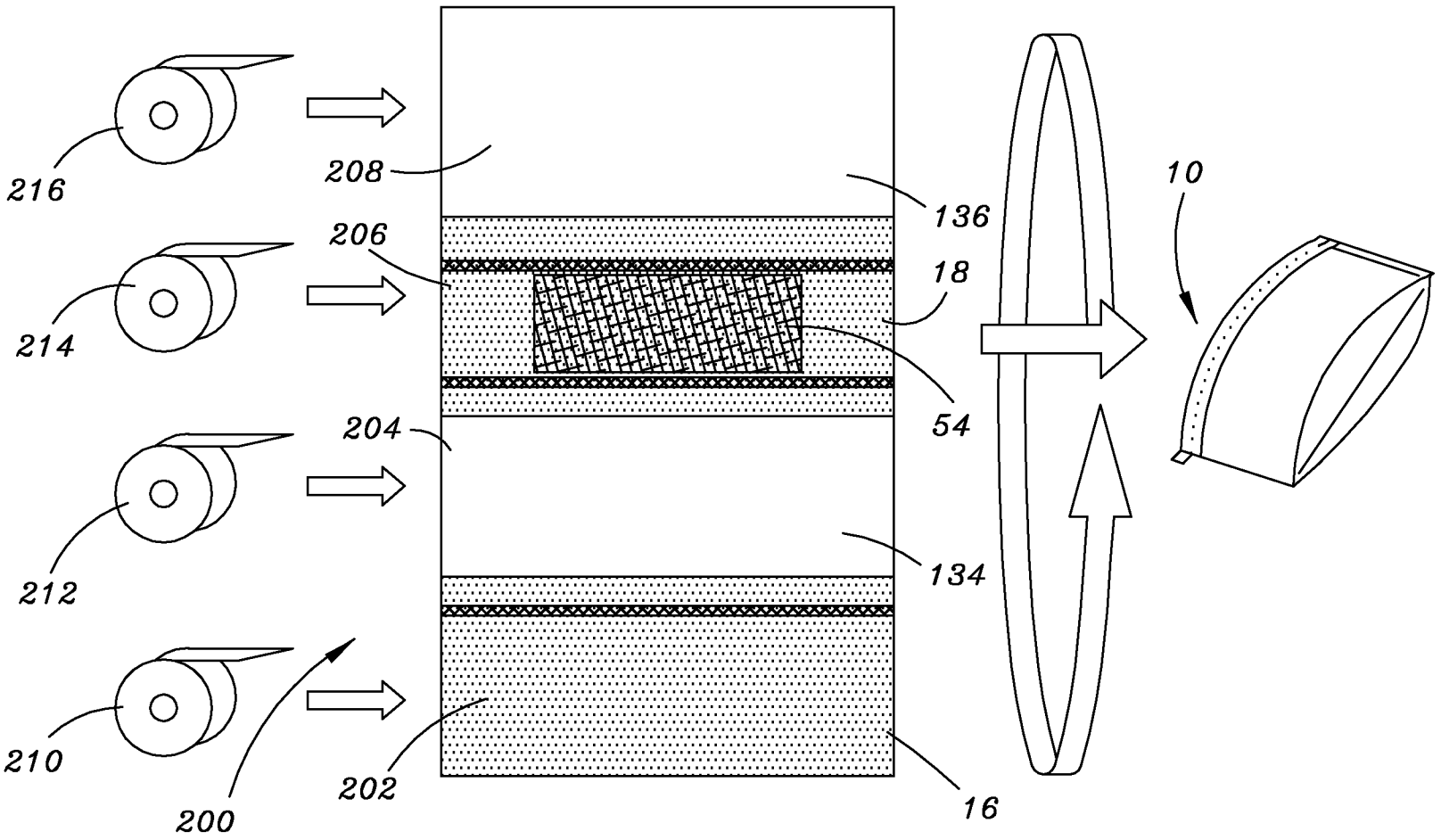
FIG. 13 is a diagrammatic plan view illustrating example separate blanks with associated roll material that are utilized to construct the microwave popcorn package in accordance with the present disclosure.

Turning now to FIG. 13, example techniques for fabricating the microwave popcorn packages 10 shown in FIGS. 9 through 12 are described. In FIG. 13, fabrication of a four-piece microwave popcorn package 10 shown in FIGS. 9 and 10 is illustrated. The unfolded package 200 (i.e., the microwave popcorn package 10 shown prior to folding) is comprised of four separate component sections 202, 204, 206, 208. As depicted in FIG. 13, each component section 202, 204, 206, 208 is formed from a separate roll or strip of stock. Thus, in the implementation shown, section 202 is formed from roll stock 210 (e.g., a roll of paper stock), section 204 is formed from roll stock 212 (e.g., a roll of polyester (PET) film stock), section 206 is formed from roll stock 214 (e.g., a roll of paper stock), and section 208 is formed form roll stock 216 (e.g., a roll of polyester (PET) film stock). As depicted, the unfolded package 200 is folded so that section 202 forms the first panel 16, section 204 forms the first end portion 134 (including bottom (e.g., first) gusset 42), section 206 forms the second panel 18, and section 208 forms the second end portion 136 (including top (e.g., second) gusset 44). During fabrication, sections 202, 204, 206, 208 are pulled from respective roll stocks 210, 212, 214, 216 and affixed together to form unfolded package 200, which is folded and filled with a food product (e.g., a popcorn charge), and sealed to form finished microwave cooking package 10. A microwave interactive construction (e.g., a microwave susceptor) 54 is illustrated as being applied to section 206. In one or more implementations, the microwave interactive construction 54 may be applied to the material of roll stock 214 (section 206) prior to fabrication of the unfolded package 200 (e.g., between plies of the material (see FIG. 10)). In other implementations, the microwave interactive construction 54 may be applied to the material of roll stock 214 (section 206) during the fabrication process (e.g., applied to the surface of the roll stock material and covered with a patch 144 (see. FIG. 9)). Techniques similar to those described above with reference to FIG. 5 may be utilized (i.e., adhesives, folding lines, etc.) to form the unfolded package 200 into the microwave cooking package 10. It is contemplated that the microwave cooking packages 10 shown in FIGS. 11 and 12 may be fabricated in a similar fashion, but with fewer rolls of stock.

In further implementations, roll stocks 210, 212, 214, 216 may be comprised of distinct materials. For instance, roll stock 210 and/or roll stock 214 may be a roll of synthetic paper such as white polymer film material, recycled paper material, or the like. In another instance, roll stock 212 and/or roll stock 216 may be a roll of glassine material, cellophane material, nylon material, or the like.

Example Vent Assembly

During popping, the flexible bag construction 14 is expanded from a collapsed configuration, shown in FIGS. 1 and 2, to an expanded configuration, shown in FIGS. 3 and 8, by steam (and/or other gases) generated during popping and/or the expanded volume of the popped popcorn of the popcorn charge 32. This expansion places stress on the various seals of the bag construction 14 (e.g., seals along ends 20, 22), which, in some instances, could cause the seals to fail (open) spilling contents such as unpopped popcorn kernels, oils, seasonings, popped popcorn, and so on from the package 10.

Accordingly, the flexible bag construction 14 includes a vent assembly 100 configured to vent pressure within the bag construction 14 during popping. In the illustrated implementation, the vent assembly 100 is formed within the top gusset 44 of the flexible bag construction 14 and is spaced away from an end (e.g., end 22) of the package 10. For instance, in one example, the vent assembly 100 may be provided in the top gusset 44 so that the center of the vent assembly 100 is approximately 3 in. from an end (e.g., end 20 or end 22) of the microwave popcorn package 10. In this location, the vent assembly 100 is positioned away from the seals of the flexible bag construction 14 located at ends 20, 22. The consumer may thus grip the package 10 (e.g., at ends 20, 22) away from the vent 100 when removing the package 10 from a microwave oven following popping. Moreover, this location allows the vent assembly 100 to be spaced away from the popcorn charge 32 when the microwave popcorn package 10 is folded in thirds for storage and shipping as shown in FIG. 1; helping to prevent the wicking of oils, seasonings and so forth through the vent assembly 100.

FIGS. 14A, 14B, 14C, and 14D illustrate the vent assembly 100 in greater detail. In the illustrated implementation, the vent assembly 100 is comprised of a first portion 102 of the bag construction 14 and a second portion 104 of the bag construction 14. As shown, the first portion 102 is comprised of a section of the side 38 of the bag construction 14 adjacent to the fold line 74 at edge 52 within a strip of the bag construction 14 that extends beyond the top edge 26 of the first panel 16. Similarly, the second portion 104 comprises a section of an interior panel 80 of the gusset 44 adjacent to the fold line 74 at edge 52. The first portion 102 and the second portion 104 are thus in mirrored relation to one another so that the second portion 104 is configured to be folded against the first portion 102 when the gusset 44 is formed. In FIGS. 14A through 14D, the first portion 102 and the second portion 104 are illustrated as being generally rectangular in shape, and of at least approximately the same size. However, it is contemplated that the first portion 102 and the second portion 104 may have other shapes (e.g., square, circular, oval, triangular, polygonal, irregular, and so on), and thus are not necessarily limited to the illustrated shape. Moreover, it is contemplated that the first and second portions 102, 104 may be of different sizes.

Figure 14A:
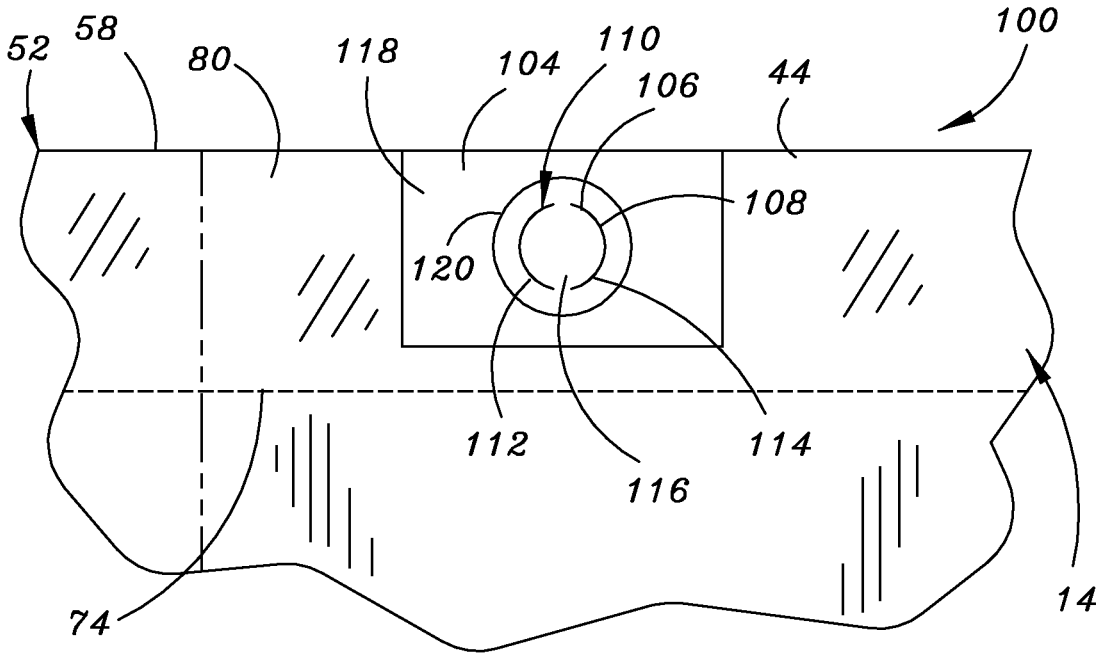
FIGS. 14A and 14B are partial side elevation views of the microwave popcorn package shown in FIG. 1, further illustrating the vent assembly prior to venting.

The second portion 104 includes a venting structure 106 formed in the sheet of polyester film material from which the bag construction 14 is fabricated. As shown in FIG. 14A, the venting structure 106 is comprised one or more scores 108 formed within the second portion 104. In the example shown, the scores 108 extend only partially through the polyester film material and form a weakened area within the second portion 104. However, it is contemplated that, due to manufacturing variations, at least some portion of one or more of the scores 108 may extend completely through the polyester film material. Moreover, it is contemplated that in some implementations of the vent assembly 100, the venting structure 106 may include apertures formed in the polyester film material in place of, or, in addition to, the scores 108 illustrated in FIG. 14A. A variety of fabrication techniques may be used to form the scores 108 in the polyester film material. For example, in the illustrated example, the scores 108 may be stamped into the polyester film material during fabrication of the microwave popcorn package. However, it is contemplated that the scores 108 may be formed prior to fabrication and/or may be formed using other techniques such as laser scoring, and so forth.

The scores 108 of the venting structure 106 may have a variety of shapes (e.g., a generally circular shape, an generally oval shape, an "X" shape, etc.). In one or more implementations, at least one of the one or more scores 108 may have a generally curved shape. For example, in FIGS. 14A and 14B, the venting structure 106 illustrated comprises a butterfly vent 110 that includes a first semi-circular score 112 and a second semi-circular score 114 formed in the polyester film material. As shown, the second semi-circular score 114 is arranged in mirrored relation to the first semi-circular score 112, and is spaced apart from the first semi-circular score 112 to form a land area 116 there between that separates the scores 112, 114.

Figure 14B:
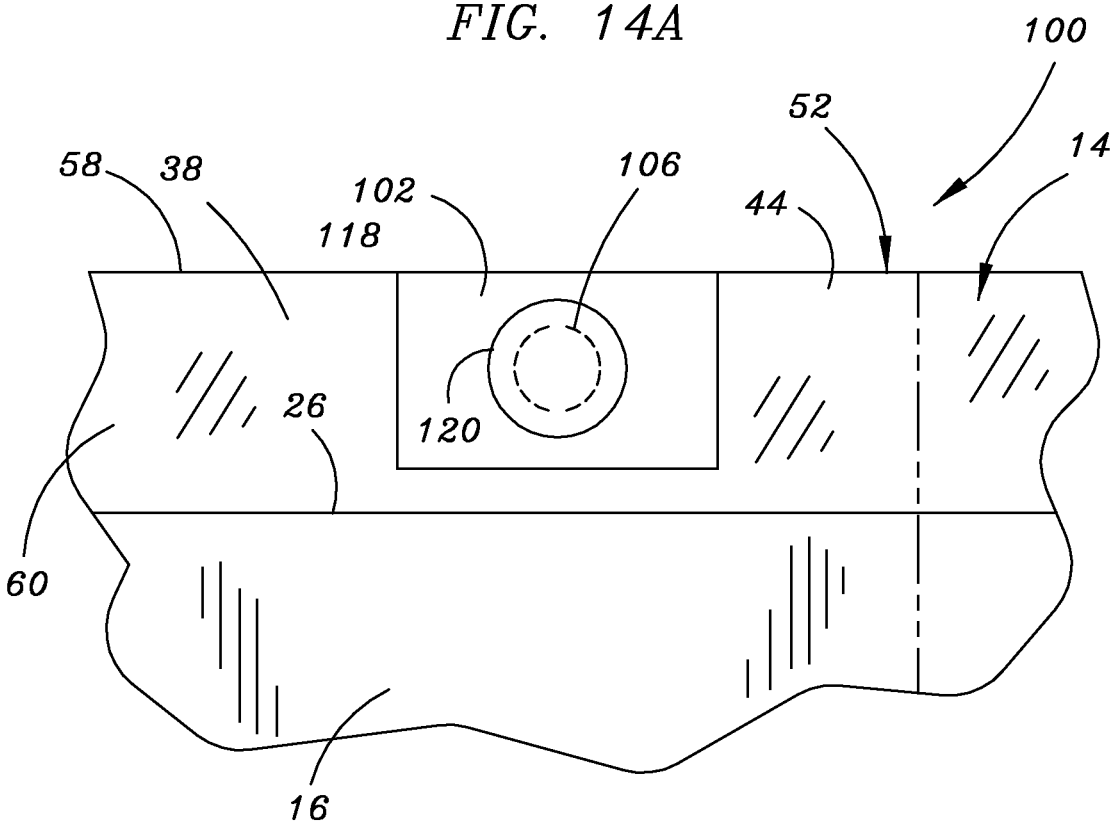

An adhesive 118 is applied to at least one of the first portion 102 or the second portion 104 of the bag construction 14. While the bag construction 14 is in the collapsed configuration, as shown in FIGS. 14A and 14B, the first portion 102 is folded against the second portion 104. Thus, in the collapsed configuration, the adhesive 118 causes the first portion 102 to be adhered to the second portion 104 to form a seal 120 around the venting structure 106. For example, in the illustrated example, the adhesive 118 may be applied to both the first portion 102 and the second portion 104 to provide an adhesive-to-adhesive contact seal 120 when the first portion 102 is folded against the second portion 104. Prior to venting, the seal 120 at least partially seals the venting structure 106 so that the contents of the bag construction 14 (e.g., unpopped popcorn kernels, oils, seasonings, and so on) are prevented from spilling from the bag construction 14 through the venting structure 106.

In the implementation shown in FIGS. 14A and 14B, the seal 120 comprises a region of the first and second portions 102, 104 surrounding the venting structure 106 in which the adhesive 118 is further activated to join the first portion 102 to the second portion 104. The seal 120 may, for example, include a region around the venting structure 106 wherein heat sealing is used to cause the adhesive 118 to secure the first portion 102 to the second portion 104 within the region. In FIGS. 14A and 14B, the activated (e.g., heat sealed) region is generally circular in shape. However, it is contemplated that the region may have other shapes (e.g., oval, square, rectangular, polygonal, irregular, and so on) without departing from the scope and spirit of this disclosure. Moreover, it is contemplated that adhesive 118 applied to the first and second portions 102, 104 outside of the seal region may function to further seal the venting structure 106, thereby preventing contents of the bag construction 14 (e.g., unpopped popcorn kernels, oils, seasonings, and so on) from migrating into the seal region around the venting structure 106.

Figure 14C:
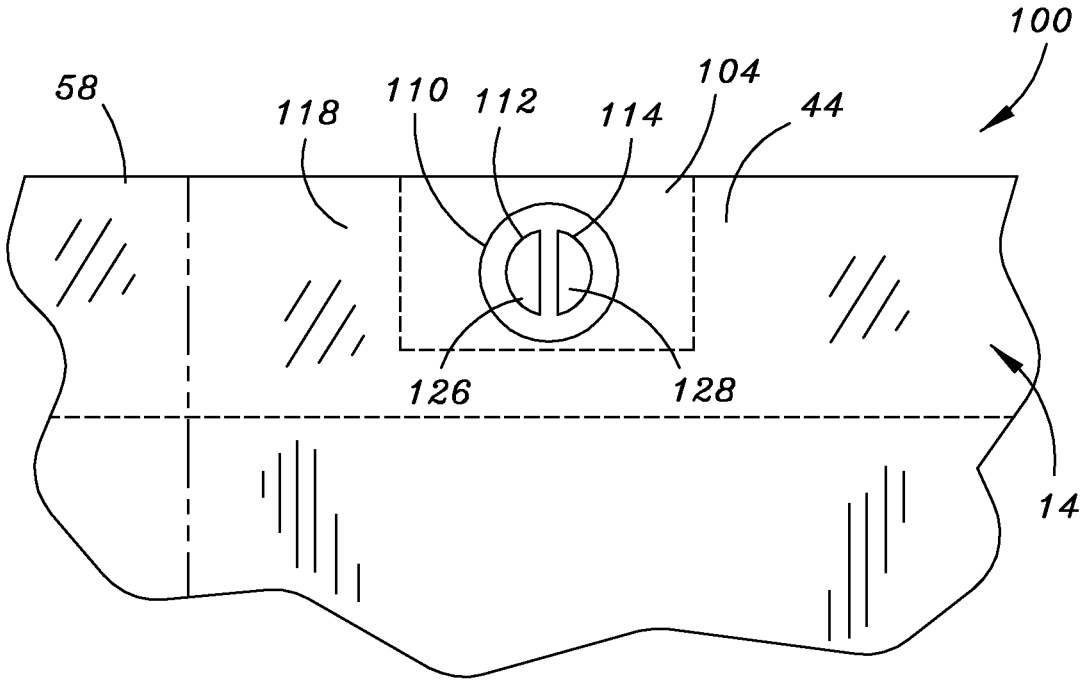
FIGS. 14C and 14D are partial side elevation views of the microwave popcorn package shown in FIG. 1, further illustrating the vent assembly following venting.
Figure 14D:
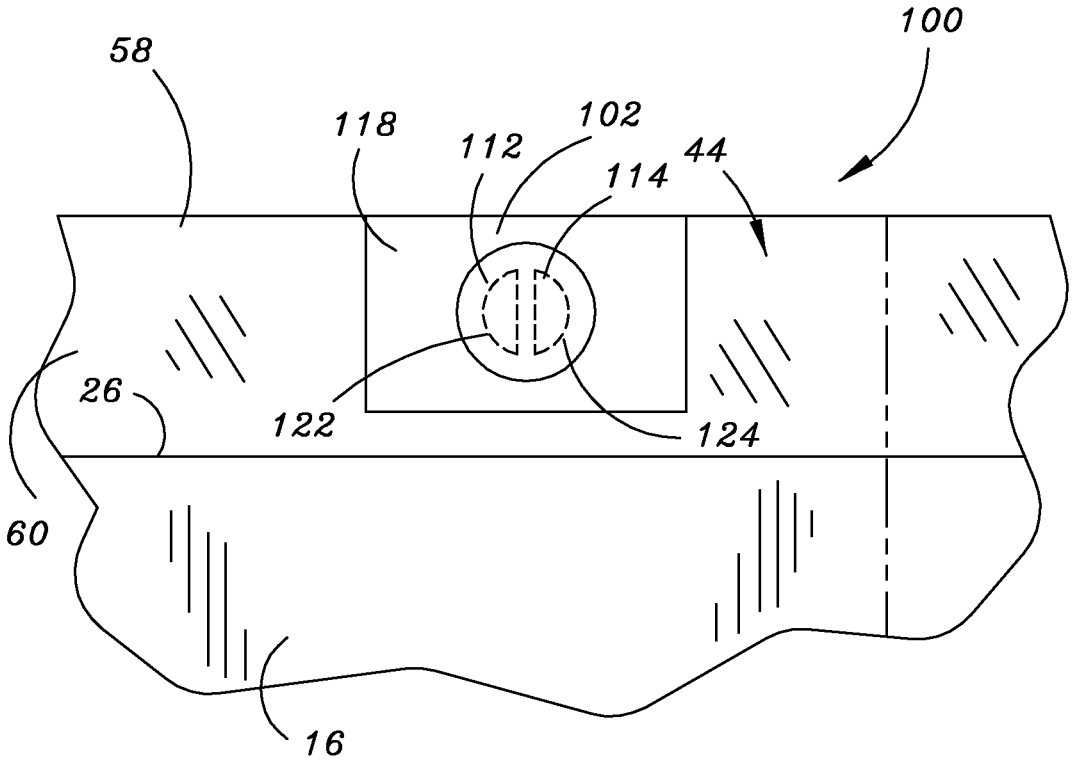

As the flexible bag construction 14 expands to the expanded configuration during popping (FIG. 3), the gusset 44 is opened causing the interior panel 62 of the gusset 44 to be pulled away from the side 38 of the bag construction 14 about the fold line 58. Thus, during expansion of the flexible bag construction 14, the second portion 104 tends to be pulled away from the first portion 102. As the first and second portions 102, 104 are pulled apart; the adhesive 118 is configured to release the first portion 102 from the second portion 104 to allow the venting structure 106 to at least partially open, venting the bag construction 14. For instance, as shown in FIGS. 14C and 14D, the first and second semi-circular scores 112, 114 of the butterfly vent 110 may be configured to at least partially open when the first portion 102 is released from the second portion 104. The first and second semi-circular scores 112, 114 define a first flap 122 and a second flap 124, respectively. When the first portion 102 is pulled away from the second portion 14 (e.g., due to expansion of the bag construction 14), at least part of either or both of the first and second flaps 122, 124 remain adhered to the first portion 102. Thus, the first and second flaps 122, 124 are pulled away from the remainder of the second portion 104 creating one or more vent apertures 126, 128 in the second portion 104 through which steam (and other gases) may vent from the bag construction 14. In some implementations, the parts of the first and second flaps 122, 124 that are pulled away from the second portion 104 may remain adhered to the first portion 102 by the adhesive 118 after the first portion 102 is released from the second portion 104, and thus may detach from the second portion 104. Moreover, in some instances it is contemplated that portions of the second portion 102 other than the first and second flaps 122, 124 may pull from the second portion 104, and may remain adhered to the first portion 102, creating vent apertures 126, 128 that are irregular in shape.

The vent assembly 100 is configured to provide efficient venting of steam and other gases from the flexible bag construction 14 during popping. For example, the vent assembly 100 may include a venting structure 106 that is sufficiently large to vent the bag construction prior to failure (opening) of seals within the bag construction 14 (e.g., seals along ends 20, 22) due to pressure within the bag construction 14 during popping. In examples, the venting structure 106 may comprise a butterfly vent 110 that includes a first semi-circular score 112 and a second semi-circular score 114 having diameters of between about 0.1875 in. and about 0.3125 in. In one specific example, the first semi-circular score 112 and the second semi-circular score 114 may have diameters of about 0.25 in., while the land 116 has a width of about 0.04 in. When opened, each semi-circular score 112, 114 may provide a vent aperture 126, 128 having an area of at least about 0.02 $in^2$ if fully opened. Moreover, while the microwave package assembly 10 is illustrated as including one vent assembly 100, it is contemplated that two or more vent assemblies 100 may be provided in the flexible bag assembly 14 without departing from the scope and spirit of the present disclosure.

In implementations, the vent assembly 100 may be configured to vent (open) at an approximate, predetermined time during the popping operation (e.g., near the end of a popping operation). In this manner, the flexible bag construction 14 may be allowed to inflate during popping so that visibility of the popping popcorn within the bag construction 14 is enhanced and/or a desired pressure within the bag construction 14 is maintained to enhance popping of the popcorn. For example, the seal strength provided by the adhesive 118 may be selected to prevent separation of the first portion 102 from the second portion 104, and thus, venting of the venting structure 106, until the bag construction 14 has reached a desired degree of expansion (inflation), but to allow separation of the first portion 102 from the second portion 104, and thus venting by the venting structure 106, prior to failure of seals within the bag construction 14.

A variety of adhesives 118 may be employed to adhere the first portion 102 to the second portion 104. In one example, the adhesive 118 may be a water-based adhesive providing approximately a 0.5 lb seal. In this example, the seals of the flexible bag construction 14 may also be made using a water-based adhesive. However, the adhesive used may provide seals having strengths greater than that of the adhesive 118 (e.g., providing approximately a 1 lb. to 2 lb. seal). The adhesive 118 of the vent assembly 100 may, for example have a different composition than the adhesive used in the seals of the flexible bag construction 14, and/or may be applied to the polyester film material in a lesser concentration. Solvent-based adhesives may also be used.

As shown in FIG. 5, the adhesive 116 may be applied to the bag blank 36 as an adhesive field 130. As shown in FIG. 13, the adhesive 116 may also be applied to the sections 202, 204, 206, 208 of roll stocks 210, 212, 214, 216, respectively, as the sections 202, 204, 206, 208 are affixed together to form an unfolded package 200. Scores 108 (e.g., semi-circular scores 112, 114) may be stamped into the polyester film material within the adhesive field 130 prior to, or during, folding of the bag blank 36 (FIG. 5) or unfolded package 200 (FIG. 13). As the top gusset 44 is folded, the first and second portions 102, 104 are folded together as described above, providing an adhesive-on-adhesive contact. The first and second portions 102, 104 may then be heat sealed to form seal 120 around the venting structure 110 (e.g., around scores 108 stamped into the polyester film material). Folding and sealing of the blank 36 (FIG. 5) or unfolded package (FIG. 13) to form the microwave popcorn package is then completed. A popcorn charge 36 is inserted into the bag construction 14 as shown in FIGS. 4, 9, 10, 11, and 12. In the implementation shown in FIG. 5, adhesive may be applied at areas 132 to help maintain the shape of the bag construction 14 as the popcorn charge 32 is inserted and to prevent inadvertent opening of the vent assembly 100.

Example Use

The microwave popcorn packages 10 described above may be sealed within a moisture protective outer wrap (e.g., a sealed wrap formed of a polyester (PET) film material) once assembled. In some instances, the microwave popcorn packages 10 may further be packaged into boxes for storage, shipping, and/or display. In use, the package 10 is removed from the moisture protective outer wrap and placed in a microwave oven with the second panel 18 down. A typical microwave popcorn package 10 may be configured to yield full popping within a period of about 2 to 5 minutes in a typical household microwave oven, on high setting. After popping, top gusset 44 is removed to allow the microwave popcorn package 10 to function as a container (e.g., a bowl-like structure) for consumption of the popped popcorn as depicted in FIG. 8.

CONCLUSION

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A microwave package comprising:

a sidewall construction defining an interior, the sidewall construction including a first side panel and a second side panel, the first side panel and the second side panel joined at opposed side ends, the first side panel and the second side panel forming an opening between the opposed side ends, the sidewall construction being selectively expandable between a collapsed configuration and an expanded configuration; and a bag construction enclosing the opening between the first side panel and second side panel, a portion of the bag construction being secured to the interior of the sidewall construction, the bag construction being selectively expandable between the collapsed configuration and the expanded configuration, wherein the bag construction and the sidewall construction form a container having vertical sidewalls in the expanded configuration.

2. The microwave package as claimed in claim 1, wherein the base is a bottom gusset.

3. The microwave package as claimed in claim 2, wherein the bottom gusset is directed inwardly between a first side and a second side of the flexible bag construction in the collapsed configuration.

4. The microwave package as claimed in claim 1, wherein the sidewall construction defines a ring configuration.

5. The microwave package as claimed in claim 1, wherein the sidewall construction includes a plurality of creases for adaptation from the collapsed configuration to the expanded configuration.

6. The microwave package as claimed in claim 1, wherein the flexible bag construction includes an outward projecting-portion that projects outwardly from the sidewall construction and is adapted to be removed from a remainder of the flexible bag construction.

7. The microwave package as claimed in claim 6, wherein the outward projecting-portion projects outwardly from the sidewall construction in the collapsed configuration.

8. The microwave package as claimed in claim 6, wherein a tear strip that is selectively removable is disposed around the portion of the flexible bag construction that extends outwardly from the sidewall construction.

9. The microwave package as claimed in claim 1, further comprising a microwave interactive construction positioned in thermoconductive relation to the sidewall construction.

10. The microwave package as claimed in claim 9, wherein the flexible bag construction includes an outer ply and an inner ply with the microwave interactive construction positioned between the outer and inner plies.

11. A microwave popcorn package comprising:

a sidewall construction including a first side panel and a second side panel, the sidewall construction defining an interior between the first and second side panels, the first side panel and the second side panel joined at opposed side ends, the first side panel and the second side panel forming an opening between the opposed side ends, the sidewall construction being selectively expandable between a collapsed configuration and an expanded configuration, wherein the sidewall construction forms vertical sidewalls in the expanded configuration;

a bag construction having a first bag side, a second bag side, and a bag base, a portion of the first bag side secured to the first side panel of the sidewall construction, a portion of the second bag side secured to the second side panel of the sidewall construction, the bag base extending between the first and second sides of the bag construction, the bag construction being selectively expandable between the collapsed configuration and the expanded configuration, wherein the first side, the second side, and the base of the bag construction define an interior, the base of the bag construction is configured within the opening formed by the first side panel and second side panel; and a popcorn charge disposed in the interior of the bag construction.

12. The microwave package as claimed in claim 11, wherein the base is a bottom gusset.

13. The microwave package as claimed in claim 12, wherein the bottom gusset is directed inwardly between a first side and a second side of the flexible bag construction in the collapsed configuration.

14. The microwave package as claimed in claim 11, wherein the sidewall construction defines a ring configuration.

15. The microwave package as claimed in claim 11, wherein the sidewall construction includes a plurality of creases for adaptation from the collapsed configuration to the expanded configuration.

16. The microwave package as claimed in claim 11, wherein the flexible bag construction includes an outward projecting-portion that projects outwardly from the sidewall construction and is adapted to be removed from a remainder of the flexible bag construction.

17. The microwave package as claimed in claim 16, wherein the outward projecting-portion projects outwardly from the sidewall construction in the collapsed configuration.

18. The microwave package as claimed in claim 16, wherein a tear strip that is selectively removable is disposed around the portion of the flexible bag construction that extends outwardly from the sidewall construction.

19. The microwave package as claimed in claim 11, further comprising a microwave interactive construction positioned in thermoconductive relation to the sidewall construction.

20. The microwave package as claimed in claim 19, wherein the flexible bag construction includes an outer ply and an inner ply with the microwave interactive construction positioned between the outer and inner plies.

* * * * *